United States Patent [19]

Bratchell

[11] Patent Number: 4,946,099

[45] Date of Patent: Aug. 7, 1990

[54] SLEEPER CONSTRUCTION

[75] Inventor: Robert L. Bratchell, Piccadilly, Australia

[73] Assignee: Amatek Limited, Chatswood, Australia

[21] Appl. No.: 301,620

[22] Filed: Jan. 24, 1989

[30] Foreign Application Priority Data

Jan. 28, 1988 [AU] Australia ..... PI6463

[51] Int. Cl.[5] ..... E01B 9/18

[52] U.S. Cl. ..... 238/264; 238/265; 238/282; 238/310; 238/319; 238/349; 238/351; 238/331; 238/270

[58] Field of Search ..... 238/264, 265, 282, 310, 238/315, 318, 349, 106, 270, 321, 331, 338, 350, 351; 52/709, 710, 711

[56] References Cited

U.S. PATENT DOCUMENTS

| | | | |
|---|---|---|---|
| 905,867 | 12/1908 | Girard | 238/265 X |
| 1,018,538 | 2/1912 | Wilde | 238/265 |
| 1,588,628 | 6/1926 | Sellers | 52/709 |
| 1,667,532 | 4/1928 | Carlson | 52/710 |
| 1,933,536 | 11/1933 | Awbrey | 52/709 X |
| 3,147,921 | 9/1964 | Delcroix | 238/310 |
| 3,282,506 | 11/1966 | Holstein | 238/349 |
| 4,470,543 | 9/1984 | Gray et al. | 238/349 X |
| 4,505,428 | 3/1985 | Matsuo et al. | 238/349 |
| 4,756,477 | 7/1988 | Schumaker | 238/315 |

FOREIGN PATENT DOCUMENTS

| | | |
|---|---|---|
| 2409510 | 9/1975 | Fed. Rep. of Germany . |
| 114110 | 7/1975 | German Democratic Rep. . |
| 116482 | 11/1975 | German Democratic Rep. . |

*Primary Examiner*—Andres Kashnikow
*Assistant Examiner*—Mark T. Le
*Attorney, Agent, or Firm*—Brown, Martin, Haller & McClain

[57] ABSTRACT

A concrete sleeper has an elongate metal insert having a T-slot containing a T-head of a retaining block which bears against a rail foot to retain rail gauge. The retaining block can be rotated by 180° and slid along the T-slot to abut an edge of the foot of a rail, the T-slot being sufficiently long to allow adjustment of the rail on the sleeper. After rail position has been determined, the block location can be fixed by inserting grout into the T-slot. Alternatively, the T-slot can have abutment lugs which determine the block position, and thereby the rail position.

5 Claims, 2 Drawing Sheets

SLEEPER CONSTRUCTION

This invention relates to securing means for securing a rail to a railway sleeper, and has particular advantage in those sleepers wherein it is necessary to secure two lines which merge such that adjustment of rail position transversely of its longitudinal axis is a most desirable feature. The invention is also useful in providing narrow and broad gauge rail retention on the same sleeper.

BACKGROUND OF THE INVENTION

It is known that various types of devices have been used heretofore for the adjustment of rails transversely of their longitudinal axes, and the reader may refer to the West German Patent 2409510/A in the name of Talke, or either one of the two East German Patents 116482/A and 114110/A both in the name of Noke. However the most desirable features in such a sleeper arrangement, as also in other civil engineering applications, include the provision of considerable strength in the adjustment means, easy positioning of the rail fasteners, and easy transverse movement of the rails.

BRIEF SUMMARY OF THE INVENTION

In this invention a concrete sleeper has an elongate metal insert having a T-slot containing a T-head of a retaining block which bears against a rail foot to retain rail gauge. The retaining block can be rotated by 180° and slid along the T-slot to abut an edge of the foot of a rail, the T-slot being sufficiently long to allow adjustment of the rail on the sleeper. After rail position has been determined, the block location can be fixed by inserting grout into the T-slot. Alternatively, the T-slot can have adjustment lugs which determine the block position, and thereby the rail position.

With the invention, a sleeper can support a rail the transverse position of which is adjustable by sliding a rail fastener retaining block along the T-slot, and, after final positioning, locking in position by insertion of a grout in the T-slot.

In an embodiment of the invention, the sleeper is provided with at least two metal inserts, each insert having surfaces defining an upwardly facing T-slot, and side walls having recesses therein by which the inserts are keyed, there being provided rail fastener retaining blocks each having a stem depending therefrom and terminating in a T-head. With this arrangement, absence of spring loaded retaining clips from their respective fastener blocks enable the rail to be moved transversely, and then retained temporarily in position by the downward force applied by spring clips and the upward reaction force between the T-heads and the inner flange surfaces which define the mouth of the T-slot, and retained permanently by a suitable filler grout, for example, an epoxy filler.

BRIEF SUMMARY OF THE DRAWINGS

An embodiment of the invention is described hereunder in detail with reference to, and is illustrated in, the accompanying drawings, in which.

DETAILED DESCRIPTION OF THE PREFERRED EMBODIMENTS

Figures 1, 5, 6:
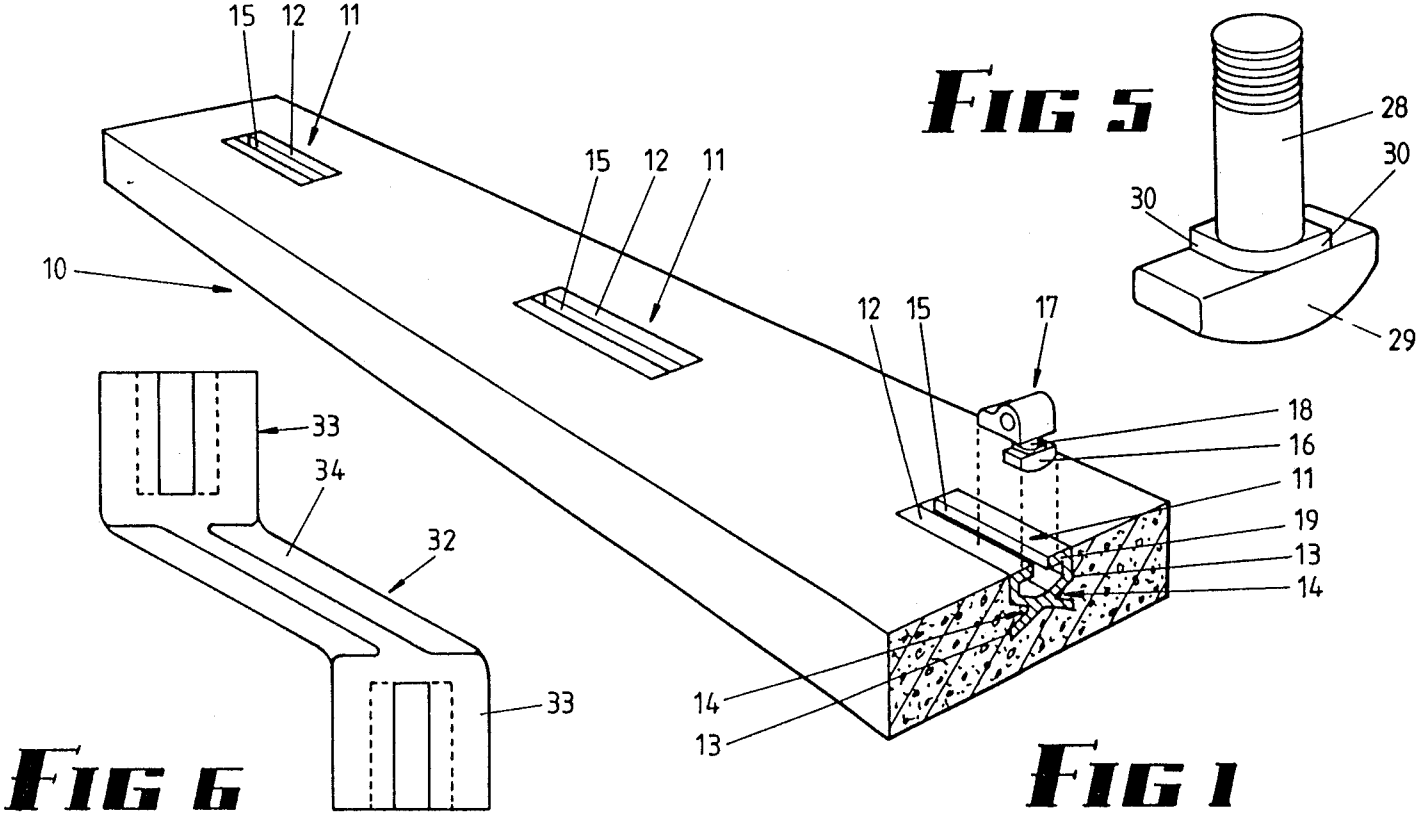
FIG. 1 is a perspective view of a railway sleeper with metal inserts embodied therein.
FIG. 5 is a perspective view of an alternative fastener retaining member.
FIG. 6 is a plan view of a metal insert of "dog-leg" shape usable for supporting rail plates.

In the embodiment of FIG. 1, a concrete sleeper 10 is provided with at least two (herein three) cast steel inserts 11. Each insert 11 has an upper planar surface 12 which is coplanar with the upper surface of the concrete sleeper 10, and it has two side walls 13 each containing a recess 14 which provides keying means whereby the concrete can firmly retain the insert to the sleeper. Tests have proved that the retention is very great indeed.

The inner surface of the upper wall of each insert 11 comprises facing flanges 19 which define a T-slot 15, and the inner surfaces of those flanges 19 where they open to the mouth of the T-slot support a T-head 16 of each of two respective fastener retaining blocks 17. The T-head 16 depends therefrom being spaced therefrom by means of a circular section stem 18, but in other respects the retaining blocks 17 are used in accordance with known art, being retained in position by means of resilient steel bars 20 of known type. By merely removing the bars 20 from the retaining blocks 17, it is possible to drive the retaining blocks 17 along the T-slots 15 and thereby reposition them, but all the retention force imparted by the deformation of the resilient bars 20 is available not merely to hold the foot of the rail 22 against the upper surface of the sleeper 10, but also a very high bearing pressure is applied to the abutting surfaces of the T-heads 16 and the bearing surfaces of the insert 11 where they open to the mouth of the T-slots 15. However, in most instances it is desirable to additionally retain the T-heads with a filler grout, for example epoxy, or Portland cement.

Figure 4:
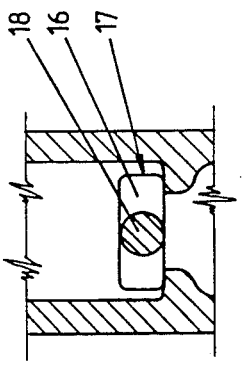
FIG. 4 is a plan-section on line 4—4 of FIG. 3.
Figure 3:
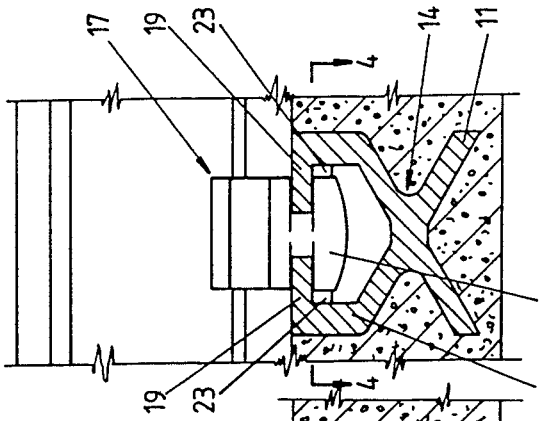
FIG. 3 is a cross-section on line 3—3 of FIG. 2.
Figure 2:
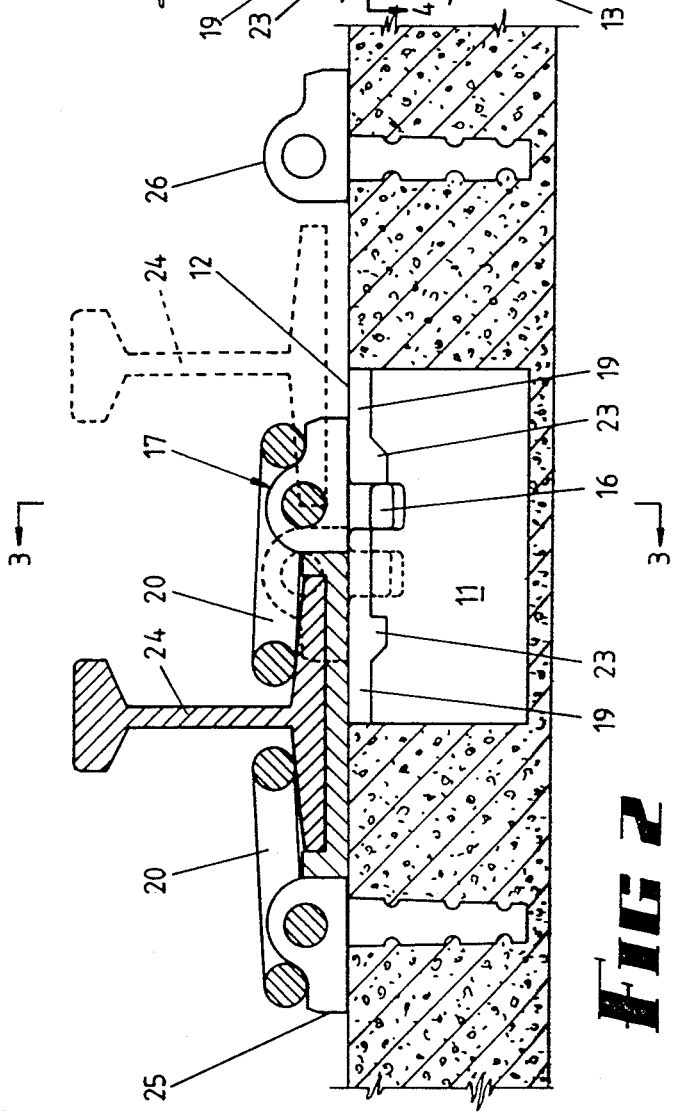
FIG. 2 is a part longitudinal section through a sleeper and insert, showing how the invention is usable for converting a railroad track from broad to narrow gauge.

FIGS. 2, 3 and 4 show the above described sleeper assembly in some further detail, but in those Figs. the insert 11 is provided with two spaced abutment lugs 23 depending from each of the flanges 19 and these position the retaining blocks 17 either to hold the rail 24 against a left hand inserted shoulder 25 as shown in full lines, or, by merely rotating the retaining block 17 urging the rail 24 against the right hand shoulder 26, when the rail is located as shown in broken lines in FIG. 2. The upper parts of the retaining blocks 17 bear against the insert upper surface and the T-head bears against the under surfaces of flanges 19, also abutting lugs 23. This is of considerable value when it is desired to change a railroad track from broad gauge to narrow gauge or vice versa. The arrangement can also be used with some modification for supporting a secondary gauge rail, for example for use across a viaduct or bridge.

In certain types of fasteners use is made of retaining bolts rather than retaining blocks. FIG. 5 shows retaining bolt 28 having a head 29 adapted to bear against the flange 19, the bolt 28 having a shoulder 30 to constrain it against rotation.

In some circumstances it is desirable to use fasteners which will interfere with each other if immediately opposite one another, and FIG. 6 illustrates a single casting 32 having two longitudinally spaced insert portions 33 joined by an intermediate portion 34 and this can be utilised in lieu of two separate inserts 11. These are of value particularly in turn out sleepers, and flat slab rail supports.

The invention is not necessarily limited to railway blocks and can be used in such applications as securing columns to foundations in buildings, or aligning heavy presses or machine tools in factories, since the heavy articles can be inaccurately positioned and subsequently moved to final position where they can be firmly locked.

The invention provides at least two very valuable advantages over prior art.

Firstly, it is unnecessary to accurately predetermine mathematically the cross-over locations of rails and sleepers, as is presently practised. The rail needs merely to be properly positioned on the sleeper, and, once location has been proved, the T-heads 16 can be permanently located by the filler.

Secondly, the danger is diminished of loss of sleeper in the case of a derailment. A derailment is likely to result in irreparable damage to the fasteners, but the old filler is mechanically removable, and new fasteners attachable, without the need to supply a complete new sleeper.

I claim:

1. A concrete sleeper assembly comprising a concrete supporting member, at least one elongate metal insert embedded in the concrete of the sleeper extending in the direction of the length of the sleeper, the insert being of general cruciform cross sectional shape, having diverging outer side walls defining V-shaped recesses by which the insert is keyed to the concrete of the sleeper, the insert side walls terminating at their upper edges in inturned flanges which define a continuous T-slot extending substantially the length of the insert, a pair of rail retaining blocks each having an upper portion bearing downwardly on the flanges, a T-head slidably mounted in the T-slot bearing upwardly against the flanges, the T-head being substantially shorter than the length of the slot, a stem joining the upper portion and the T-head, and rail clip engagement surfaces on each said retaining block, the shapes and dimensions of the insert and retaining blocks being such that, when a said insert underlies a rail foot, the T-slot extends away from the rail foot on each side thereof by an amount such that each stem and T-head is slidable in the T-slot on a respective side of the rail foot.

2. A concrete sleeper according to claim 1 having an upper surface, and having two said metal inserts spaced from one another, the upper surfaces of the inserts being coplanar with the sleeper upper surface, and two said retaining blocks carried by each said insert.

3. A concrete sleeper assembly according to claim 2 further comprising grout within each said T-slot locking said retaining blocks against movement along said T-slot.

4. The assembly as claimed in claim 1, including a rail having a rail foot which overlies a said insert, the upper portion of each said retaining block abutting a respective edge of the rail foot, respective rail clips carried by said retaining block upper portions bearing downwardly on the rail foot, and grout contained in said T-slot inhibiting displacement of respective said T-heads.

5. A concrete sleeper comprising a metal insert embedded in concrete, said insert being elongate, extending in the longitudinal direction of the sleeper, and having channel forming walls which terminate in facing flanges such that the inner surfaces of the walls define a T-slot, the inner surface also having two sets of abutment lugs, each set being spaced longitudinally from the other, a fastener retaining block slidably mounted in said insert, said retaining block having a T-head within said channel, the T-head having a size that allows the T-head to be selectively movable between a first position having one face abutting one of the abutment lug sets and a second position with the T-head being rotated within the channel through 180°, said second position being longitudinally spaced from said first position wherein said one face abuts the other abutment lug set, said retaining block also having an upper portion comprising means for bearing against an outer surface of the insert and having a rail abutting surface comprising means for abutting a rail foot edge when the T-head abuts a set of abutment lugs, and a pair of shoulders embedded in but projecting from the sleeper and spaced longitudinally from respective ends of said metal insert.

* * * * *